US007332451B2

(12) United States Patent
Barnholtz et al.

(10) Patent No.: US 7,332,451 B2
(45) Date of Patent: Feb. 19, 2008

(54) PAPERMACHINE CLOTHING HAVING REDUCED VOID SPACES

(75) Inventors: Steven Lee Barnholtz, West Chester, OH (US); Michael Gomer Stelljes, Jr., Mason, OH (US); Douglas Jay Barkey, Maineville, OH (US); Alyssandrea Hope Hamad, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 259 days.

(21) Appl. No.: 10/990,615

(22) Filed: Nov. 17, 2004

(65) Prior Publication Data

US 2006/0105660 A1 May 18, 2006

(51) Int. Cl.
*D03D 15/00* (2006.01)

(52) U.S. Cl. ..... 442/208; 442/4; 442/5; 442/32; 442/200; 442/218; 442/286; 442/301

(58) Field of Classification Search ..... 442/4, 442/32, 200, 286, 5, 208, 218, 301
See application file for complete search history.

(56) References Cited

U.S. PATENT DOCUMENTS 4,514,345 A 4/1985 Johnson et al.
4,528,239 A 7/1985 Trokhan
4,529,480 A * 7/1985 Trokhan ..... 162/109
4,731,281 A 3/1988 Fleischer et al.
5,334,289 A 8/1994 Trokhan et al.
5,496,624 A 3/1996 Stelljes, Jr. et al.
5,549,967 A * 8/1996 Gstrein ..... 442/200
5,840,637 A 11/1998 Denton et al.
5,888,915 A 3/1999 Denton et al.
6,007,911 A 12/1999 Bowen, Jr.
2006/0127641 A1* 6/2006 Barnholtz et al. ..... 428/137

FOREIGN PATENT DOCUMENTS

EP 0 070 708 A2 1/1983
GB 2097435 11/1982

* cited by examiner

*Primary Examiner*—Andrew Piziali
(74) *Attorney, Agent, or Firm*—Peter D. Meyer; David K. Matthe; Betty J. Zea

(57) ABSTRACT

Paper-machine clothing comprising a woven structure and a filling component. A filament and a second filament of the woven structure intersect in a weave pattern contact each other. Void spaces produced by the intersection of the first filament and the second filament are substantially filled by a durable filling component. The durable component adheres to at most one of the first and second filaments.

20 Claims, 3 Drawing Sheets

PAPERMACHINE CLOTHING HAVING REDUCED VOID SPACES

FIELD OF THE INVENTION

The present invention is directed to paper machine clothing. The invention is directed particularly to woven paper machine clothing for forming and drying paper webs.

BACKGROUND OF THE INVENTION

Paper machine clothing is well known in the art of papermaking. The paper machine clothing may comprise a support structure woven from metal or polymeric filaments. The intersection of filaments in the weave of the support structure may result in void spaces near the point of contact between intersecting filaments. These void spaces may harbor moisture and/or fiber fines. The presence of moisture and/or fiber fines in the void spaces may adversely impact the efficiency of the forming and drying processes involving the clothing.

The void spaces may become at least partially filled with water during the forming process. The combination of the embryonic web material and the clothing may contain additional water due to the water present in the void spaces. The additional water may require the expenditure of additional energy to remove the water from the clothing during the drying process.

The presence of fiber fines in the void spaces may impact the service life of the clothing. Fiber fines may be abrasive with respect to the clothing filaments. The motion of the clothing in the papermaking process may result in relative motion between the intersecting filaments. This relative motion may facilitate abrasion of the filaments by fiber fines present in the void spaces. Such abrasion may reduce the useful service life of the paper-machine clothing.

The presence of fines in the void spaces may increase the need to clean the clothing. The clothing may be cleaned by showering it with water. This cleaning requirement may require additional process water. Reducing the void spaces of the clothing and the attendant sanitation requirements may reduce the volume of water required for the process as a whole.

Paper machine clothing has been disclosed wherein the void spaces have been eliminated. In one example, the woven paper-machine clothing was heated to a temperature sufficient to cause the periphery of the filaments of the woven structure to melt and flow together. The clothing was subsequently cooled yielding clothing substantially devoid of the aforementioned void spaces. The intersecting filaments of resulting clothing fuse each to the other at the points of intersection. This fusion of the filaments may reduce the possible relative motion of the filaments as the paper machine clothing moves through the paper making process.

The present invention provides a woven support structure having reduced filament intersection voids that retains the capacity for relative motion of the woven filaments at the intersections of the filaments.

SUMMARY OF THE INVENTION

Paper-machine clothing comprising a woven structure having reduced void spaces at the intersection of the woven filaments in described herein. In one aspect of the invention the paper-machine clothing comprises a set of first filaments interwoven with a set of second filaments. At least one first filament contacts at least one second filament at an intersection point defining void spaces between the set of first filaments and the set of second filaments. The clothing further comprises a filling component that substantially fills the void spaces. The filling component adheres to at most one of the set of first filaments and the set of second filaments.

In another aspect of the invention, the woven clothing comprises a set of first filaments wherein at least one first filament comprises a periphery comprising a first component. The paper-machine clothing further comprises a set of second filaments, at least one second filament comprising a periphery. The second filaments interwoven and intersecting with the first filaments in a weave. The first component may flow and substantially conform to the periphery of the second filament at the intersection of the first filament and second filament in the weave. The first filament and the second filament are not bonded to each other at the intersection.

In another embodiment, the invention additionally comprises at least one deflection member defining at least one deflection conduit. The deflection conduit may provide a path for a fluid to pass through the paper-machine clothing.

BRIEF DESCRIPTION OF THE DRAWINGS

While the claims hereof particularly point out and distinctly claim the subject matter of the present invention, it is believed the invention will be better understood in view of the following detailed description of the invention taken in conjunction with the accompanying drawings in which corresponding features of the several views are identically designated and in which:

DETAILED DESCRIPTION OF THE INVENTION

As used herein weft filaments refers to filaments generally running across the length of a woven structure. For paper-machine clothing comprising a woven structure, weft filaments refers to filaments woven in the cross-machine direction.

As used herein, warp filaments refers to filaments running along the length of a woven structure. For paper-machine clothing having a woven structure, warp filaments refers to filaments woven in the machine direction.

As used herein reactive filaments refers to filaments comprising a component material as at least a portion of the periphery of the filament wherein the component material is more susceptible to softening due to an external environmental condition than the material comprising the periphery of a non-reactive filament.

The discussion that follows is in terms of the intersection of a warp filament with a weft filament. One of skill in the art understands that the clothing of the invention may comprise a plurality of such intersections between warp filaments and weft filaments.

Figure 1:
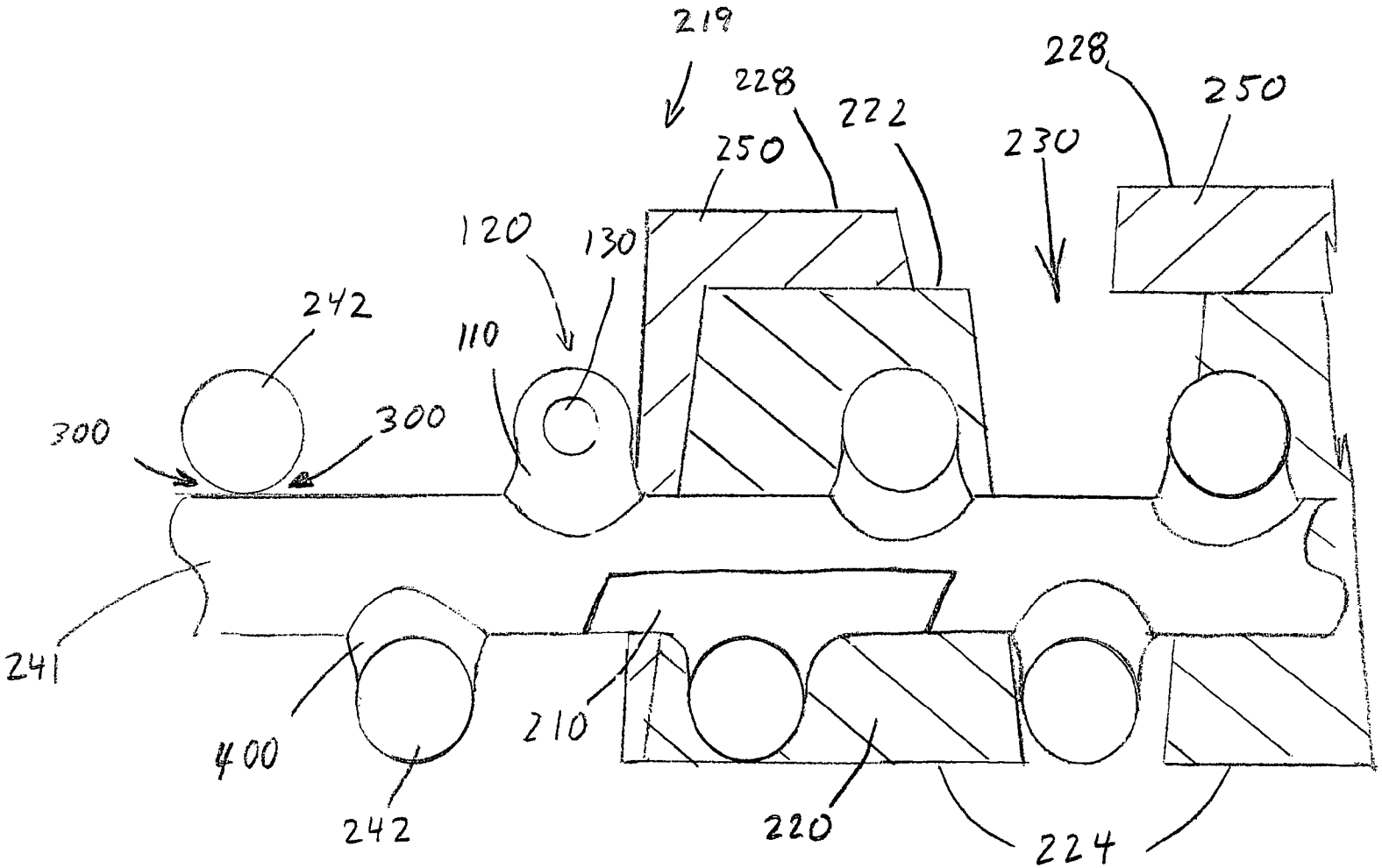
FIG. 1 illustrates a schematic cross sectional view of a paper machine clothing incorporating features of the invention.

As shown in FIG. 1, clothing 219 according to one embodiment of the invention comprises warp filaments 242 and weft filaments 241 woven each with the other. Each of the warp filaments 242 and weft filaments 241 may comprise monofilament strands, multi-filament strands, or a combination thereof. The filaments may be comprised of metal or polymeric materials. The respective filaments 242, 241, may be homogeneous or may comprise regions of differing materials. The warp filaments 242 may differ from the weft filaments 241. The component materials of the warp filaments 242 and weft filaments 241 may differ each from the other. The surface textures and surface energies of the warp filaments 242 and weft filaments 241 may also vary from each other. As shown in the figure, at least one warp filament contacts at least one weft filament at an intersection point. The contact defines void spaces 300 between the warp filament 242 and the weft filament 241. The void spaces 300 may be considered to be between a first set of filaments, warp filaments 242, and a second set of filaments, weft filaments 241.

The void spaces 300 at any particular intersection of a warp filament 242 and weft filament 241, may be considered the spaces bounded by the filaments and a set of imaginary planes. This set of planes may comprise two pairs of planes. A first pair of planes defined as perpendicular to the plane of the clothing and perpendicular to the weft filament 242. One plane of the first pair intersects the peripheral cross section of the warp filament at a point furthest to the left of a warp filament cross-sectional bisector. The other plane of the first pair intersects the warp filament peripheral cross-section at a point furthest to the right of a warp filament cross-sectional bisector.

Similarly, a second pair of planes is defined as perpendicular to the plane of clothing and perpendicular to the warp filament 242. One plane of the pair intersects the peripheral cross section of the weft filament 241 at a point furthest to the left of a weft filament peripheral cross-sectional bisector. The other plane of the-pair intersects the weft filament peripheral cross-section at a point furthest to the right of the weft filament peripheral cross-sectional bisector.

As shown in FIG. 1, the woven clothing may further comprise a filling component 400 that substantially fills the void spaces 300. The filling component 400 may completely or partially fill the void spaces 300. The filling component 400 may adhere to at most one of the warp filament 242 and the weft filament 241. The filling component may be considered to adhere to at most one of the set of warp filaments 242, or the set of weft filaments 241.

In one embodiment the filling component 400 does not adhere to either the warp filament 242 or the weft filament 241. In this embodiment, the filling component 400 may at least partially encircle the intersection of the warp filament 242 and the weft filament 241. The warp filament 242 and weft filament 241 may move independently of the filling component 400.

In one embodiment the filling component 400 may adhere to either the warp filament 242 or the weft filament 241. As an example, the filling component 400 may adhere to the warp filament 242. In this example, the weft filament 241 may be free to move independently of the warp filament 242 and the filling component 241. The warp filament 242 may have surface energy and/or other characteristics that differ from those of the weft filament 241. These characteristic differences may predispose the filling component to selectively adhere to the warp filament 242.

In one embodiment the filing component 400 comprises a powder applied to the clothing 219, to one of the warp filaments 242, or the weft filaments 241. The clothing 219 may be heated after the application of the powder such that the powder melts. Without being bound by theory, applicants believe that the melted powder may flow into and substantially fill the void spaces 300 due to capillary forces. The powder may be selected such that the melted powder will harden and adhere to at most one of the warp filaments 242 or weft filaments 241.

In another embodiment, the filling component 400 may comprise a portion of an emulsion or dispersion. The filling component 400 of this embodiment may be selected with regard to the surface energies of the warp filaments 242 and weft filaments 241 such that the emulsion or dispersion will only wet one of the two respective filaments. The filling component portion of the emulsion or dispersion may substantially fill the void spaces 300. The carrier fluid or solvent may subsequently be evaporated or otherwise driven off leaving the filling component 400 substantially filling the void spaces 300. The filling component 400 may cured such that the filling component 400 adheres to at most one of the warp filaments 242 or weft filaments 241.

Exemplary filling components 400 for this embodiment include, without being limiting, polyesters, polyurethanes, polyacrylates, methylacrylates, polyvinyl ethers, polyvinyl alcohols, and combinations thereof. Exemplary solvents may include, without being limiting, methanol, ethanol, water, isopropanol, tetrahydrofuran, ethers, and mixtures thereof.

In another embodiment, the filling component 400 may comprise a fluid that is applied to the clothing 219. The filling component may flow into and substantially fill the void spaces 300. The filling component may be partially removed by passing a second fluid through the clothing 219 with sufficient energy to remove some of the filling component 400 but with insufficient energy to overcome the capillary forces acting upon the filling component 400 substantially filing the void spaces 300. The fluid filling component 400 may then be hardened by a reaction with a third fluid or through the exposure of the filling component 400 to activating radiation, or by heating the filling component 400.

In such an embodiment, the viscosity of the filling component fluid may be manipulated by altering the chemical formulation of the fluid or by altering the temperature of the fluid. This manipulation of the fluid viscosity may enable the removal of more or less of the fluid. The manipulation of the fluid viscosity may alter the force required to remove the fluid from the clothing. Fluid will be retained in the void spaces 300 unless the capillary forces acting upon the fluid are overcome. Manipulating the fluid viscosity may lower the force necessary to remove fluid from other portions of the clothing 219 without a corresponding lowering of the capillary forces acting upon the fluid. In such circumstances the removal of the fluid from substantially all of the clothing except the void spaces 300 may be accomplished.

In another embodiment the filling component may comprise a portion of one of the warp filaments 242 or weft filaments 241. As an example illustrated in FIG. 1, the warp filament 120 may comprise a bi-component filament. At least a portion of the periphery of at least one of the warp filaments 120 may comprise a component material 110 having a melting point lower than the melting point of the periphery of the weft filaments 241. In this embodiment, the woven structure may be heated such that the component material 110 softens, flows into, and fills the void spaces 300. The clothing 219 may subsequently be cooled such that the component material 110 hardens and substantially remains in the void spaces 300. The component material 110 and weft filaments 241 may be selected such that the component material 110, that is softened and subsequently hardened, will not generally adhere to the weft filaments 241. In such an embodiment, the component material 110 functions as the filling component.

In one embodiment, the tension of the weave may yield a significant pressure between the warp filament 242 and the weft filament 241. This pressure may reduce the temperature at which the component material 110 softens and flows to substantially fill the void spaces 300. The component material 110 may soften and flow at a temperature below the nominal melting point of the component material 110.

In the embodiment shown in FIG. 1, the weft filaments 241 may comprise bi-component filaments having a component material 210 comprising at least a portion of the periphery of the weft filaments 241. In this embodiment, the woven structure may be heated such that the component material 210 softens and flows to fill the void spaces 300. The woven structure may subsequently be cooled such that the component material 210 hardens and substantially remains in the void spaces 300. The component material 210 and warp filaments 242 may be selected such that the component material 210 that is softened and subsequently hardened will not generally adhere to the warp filaments 242.

In another embodiment the warp filament 242 may comprise a component material 110 comprising at least a portion of the periphery of the warp filament 242. In this embodiment, the component material 110 may be selected such that the component material 110 will soften and flow in the presence of a particular type of solvent and may subsequently be hardened with the removal of the solvent, by exposure to thermal energy or exposure to activating radiation. The softened component material 110 may flow into and substantially fill the void spaces 300 of the clothing 219. In one such embodiment, the weft filaments may be selected such that the periphery of the weft filaments 241 is resistant to the action of the solvent and also such that the softened and subsequently hardened component material 110 will not adhere to the weft filament 242.

In the above described embodiments, the non-reactive woven filaments—the weft filaments 241 in embodiments wherein the component material that softens and flows comprises a portion of the warp filaments 242, and the warp filaments 242 in any embodiment wherein the component material that softens and flows to fill the void spaces 300 comprise a portion of the weft filaments 241—may comprise monofilaments, multi filaments or a combination of these. The non-reactive woven filaments may comprise non-reactive bi-component filaments. Non-reactive bicomponent filaments may be selected such that no portion of the periphery of the filaments will adhere to the reactive filaments.

The reactive bi-component filaments in any of the above described embodiments may comprise a concentric sheath—core structure, an eccentric sheath core structure, a side by side structure, a pie wedge structure, a hollow pie wedge structure, an islands—sea structure, or a three islands structure as each of these structures is known in the art of bi-component fibers. As an example, illustrated in FIG. 1, bicomponent filament 120 comprises a core 130 and a sheath 110. Any other bi-component filament structure wherein at least a portion of the bicomponent filament periphery comprises a reactive component material having a melting point lower than that of the material selected for the periphery of the non-reactive woven filaments, or being more susceptible to softening in the presence of a solvent than the material comprising the periphery of the non-reactive woven filaments may be exploited in the clothing 219 of the invention.

Suitable bicomponent fiber materials include, without being limiting, combinations of co-polyester/poly(ethylene terephthalate), polyamide/poly (ethylene terephthalate), polyamide/polyamide, polyethylene/poly (ethylene terephthalate), polypropylene/poly(ethylene terephthalate), polyethylene/polyamide, polypropylene/polyamide, thermoplastic polyurethane/polyamide and thermoplastic polyurethane/poly(ethylene terephthalate).

As an example, weft filaments comprising bicomponent filaments having a poly(ethylene terephthalate) sheath surrounding a polyphenylene sulfide core may be interwoven with warp filaments comprising a polyphenylene sulfide sheath surrounding a poly(ethylene terephthalate) core.

Either of the warp filaments 242 or the weft filaments 241 may comprise a material opaque to at least a portion of the electromagnetic spectrum. Opaque filaments may at least partially block the transmission of actinic radiation through the clothing 219.

In one embodiment, the clothing 219 may comprise a single layer of woven filaments. In one such embodiment the single layer of woven filaments may comprise multiple layers of warp filaments 242 interwoven with a single layer of weft filaments 241. In another such embodiment, the single layer of woven filaments may comprise multiple layers of weft filaments 241 interwoven with a single layer of warp filaments 242. In yet another such embodiment, the single layer of woven filaments may comprise multiple layers of warp filaments 242 interwoven with multiple layers of weft filaments 241. Each of these embodiments is considered to comprise a single layer of woven filaments. Each described embodiment comprises a single woven structure and may not be separated into distinctly different woven structures.

In contrast to clothing 219 comprising a single layer of woven filaments, the clothing 219 may comprise multiple layers of woven filaments that are joined together as is known in the art. In an embodiment comprising multiple layers of woven filaments, the clothing 219 may be separated into distinctly different woven layers by the removal or elimination of a portion of the clothing 219 that serves to join the multiple woven layers to each other.

Clothing 219 comprising multiple woven structures, or comprising multiple layers of warp and/or weft filaments, may also comprise additional void spaces between the stacked warp or weft filaments. The filling component of the invention may at least partially fill these void spaces.

In one embodiment, the stacked filaments may contact each other. In another embodiment small gaps may exist between the stacked filaments. In either embodiment the stacked filaments may comprise capillary spaces. The filling component may flow into and at least partially fill the void spaces. At least partially filling these void spaces may reduce the energy and sanitation requirements associated with the clothing. Partially or substantially filling these void spaces may be accomplished without deleteriously reducing the air flow capacity of the clothing 219.

The reactive filaments and non-reactive filaments of the clothing 219 may each comprise a longitudinal cross-section and a radial cross-section. A longitudinal cross-section is considered to be a planar section taken along the length of the filament. A radial cross-section is considered to be a planar section taken perpendicular to the length of the filament. In one embodiment the cross sections of the reactive filaments may change as the component material of the reactive filament softens in response to the application of heat, exposure to a solvent, or other activating means. The softened component material may flow to occupy the void spaces at the intersection of the reactive filament and the non-reactive filament. The flow of the component material into the void spaces may alter the radial and/or longitudinal cross-sections of the reactive filaments such that one or more of the reactive filament cross-sections substantially conform to the cross-sections of the non-reactive filament.

In another embodiment, each of the warp filaments 242 and weft filaments 241 comprise reactive filaments. In this embodiment, the warp and weft filaments 242, 241, react to the application of heat, the exposure to a solvent, or other activation means and a portion of the periphery of each filament softens and flows. In this embodiment, the component materials of the warp filaments 242 and the weft filaments 241 may be selected such that the softened component materials do not generally mix together. In this embodiment, the component materials of the warp filaments 242 and weft filaments 241 may be selected such that they do not adhere each to the other. The component materials 110 of the warp filaments 242 of this embodiment may further be selected such that the softened component materials 110 do not adhere to the weft filaments 241. Similarly the component material 210 of the weft filament 241 may be selected such that the softened component material 210 of the weft filament 241 does not adhere to the warp filament 242.

As used herein, filaments not adhering each to the other or component materials not generally adhering to non-reactive filaments means that there is no chemical reaction between the non-adhering components resulting in a bonding of the components each to the other.

In any of the above described embodiments, the activation of the component material of bicomponent filaments may be accomplished without a substantial reduction in the air permeability of the woven structure. The component material may be activated such that the component softens and flows sufficiently to substantially fill the void spaces created by the filament intersections in the weave pattern. Filling the void spaces may not substantially reduce the air permeability of the woven structure.

Alternatively, the activation of the component material may yield a significant reduction in the air permeability of the woven structure. The component material may be activated such that the material partially or substantially fills the open areas of the woven structure thereby reducing the air permeability of the woven structure.

As illustrated in the embodiment shown in FIG. 1, the clothing 219 of the present invention may further comprise one or more deflection members 220. The deflection member 220 may comprise a macroscopically monoplanar surface 222. The macroscopically monoplanar surface 222 may comprise a pattern. The deflection member(s) 220 may define one or more deflection conduits 230. Deflection conduits 230 may extend from a first surface 222 of the deflection member 220 to a second surface 224 of the deflection member 220. The deflection conduits 230 may provide a path for the movement of fluid from the first surface 222 to the second surface 224.

The clothing of the invention may be used to support an embryonic web material. The presence of the deflection conduits may enable the deflection of the embryonic web material from the first surface into the deflection conduit. The deflection of the embryonic web material may provide a means of imparting a structure to the embryonic web material. The passage of fluid from the first surface to the second surface may facilitate the deflection of the embryonic web material into the deflection conduit. The fluid may comprise a gas, a liquid, or a combination of these.

As a non-limiting example, the clothing may support a fibrous embryonic web material. Air may be forced through the embryonic web and subsequently through the clothing. The movement of the air may force fibers of the embryonic web to deflect into the deflection conduits and may also remove moisture from the embryonic web. The air may also at least assist in removing moisture from the embryonic fibrous web and in the stabilization of the web.

As illustrated in FIG. 1, the additional deflection members 250 may comprise multiple macroscopically monoplanar surfaces 228 each having a distinct elevation. In this embodiment, the distinct elevation of the macroscopically monoplanar surfaces 222, 228, may differ each from the others. In this embodiment, each of the respective macroscopically monoplanar surfaces 222, 228, may comprise a continuous pattern, a semi-continuous pattern, a discontinuous pattern and combinations thereof.

Figure 2:
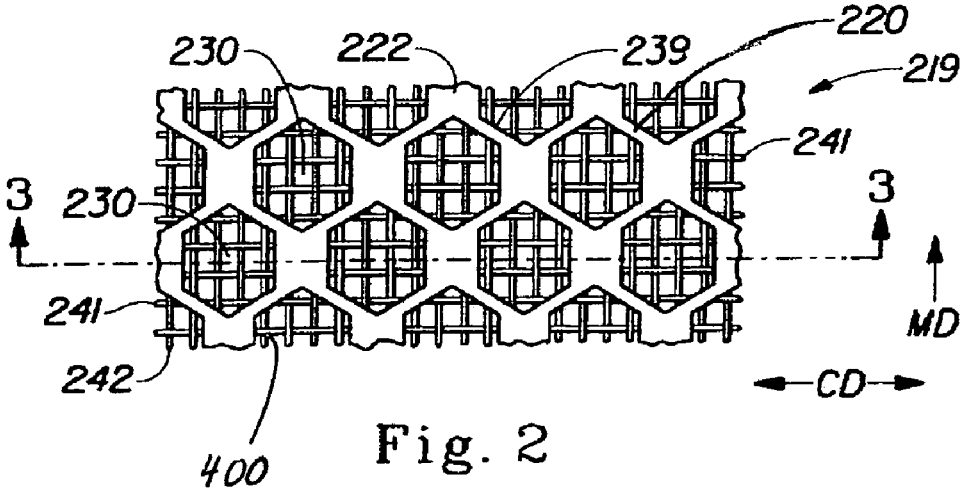
FIG. 2 illustrates a schematic plan view of an embodiment of the invention.

In another embodiment shown in FIG. 2, the deflection member 220 of the clothing 219 comprises a macroscopically monoplanar, patterned, continuous network web imprinting surface 222. The continuous network web imprinting surface 222 defines within the clothing 219 a plurality of discrete, isolated, non-connecting deflection conduits 230. The deflection conduits 230 have openings which can be random in shape and in distribution, but which are preferably of uniform shape and distributed in a repeating, preselected pattern on the deflection member 220. Such a continuous network web imprinting surface 222 and discrete deflection conduits 230 are useful for forming a paper structure having a continuous, relatively high density network region and a plurality of relatively low density domes dispersed throughout the continuous, relatively high density network region.

Suitable shapes for the openings 230 include, but are not limited to, circles, ovals, and polygons, with hexagonal shaped openings 230 shown in FIG. 2. The openings 230 can be regularly and evenly spaced in aligned ranks and files. Alternatively, the openings 230 can be bilaterally staggered in the machine direction (MD) and cross-machine direction (CD), as shown in FIG. 2, where the machine direction refers to that direction which is parallel to the flow of the web through the equipment, and the cross machine direction is perpendicular to the machine direction. A clothing 219 having a continuous network deflection member 220 and discrete isolated deflection conduits 230 can be manufactured according to the teachings of the following U.S. Patents: U.S. Pat. No. 4,514,345 issued Apr. 30, 1985 to Johnson et al.; U.S. Pat. No. 4,529,480 issued Jul. 16, 1985 to Trokhan; and U.S. Pat. No. 5,098,522 issued Mar. 24, 1992 to Smurkoski et al.

Figure 3:
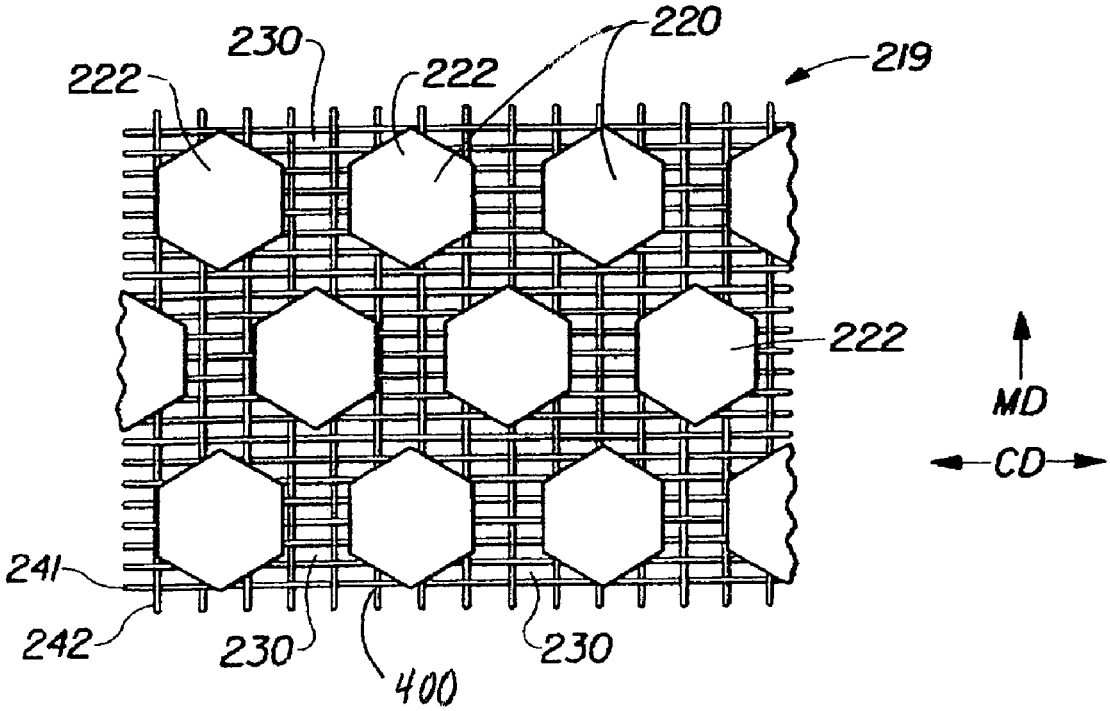
FIG. 3 illustrates a schematic plan view of another embodiment of the invention.

In another embodiment shown in FIG. 3, the foraminous clothing 219 can have a deflection member 220 comprising a continuous patterned deflection conduit 230 encompassing a plurality of discrete, isolated web imprinting surfaces 222. The clothing 219 shown in FIG. 3 can be used to form a molded web having a continuous, relatively low density network region, and a plurality of discrete, relatively high density regions dispersed throughout the continuous, relatively low density network. A clothing 219 such as that shown in FIG. 3 can be made according to the teachings of U.S. Pat. No. 4,514,345 issued Apr. 30, 1985 to Johnson et al.

Figure 4:
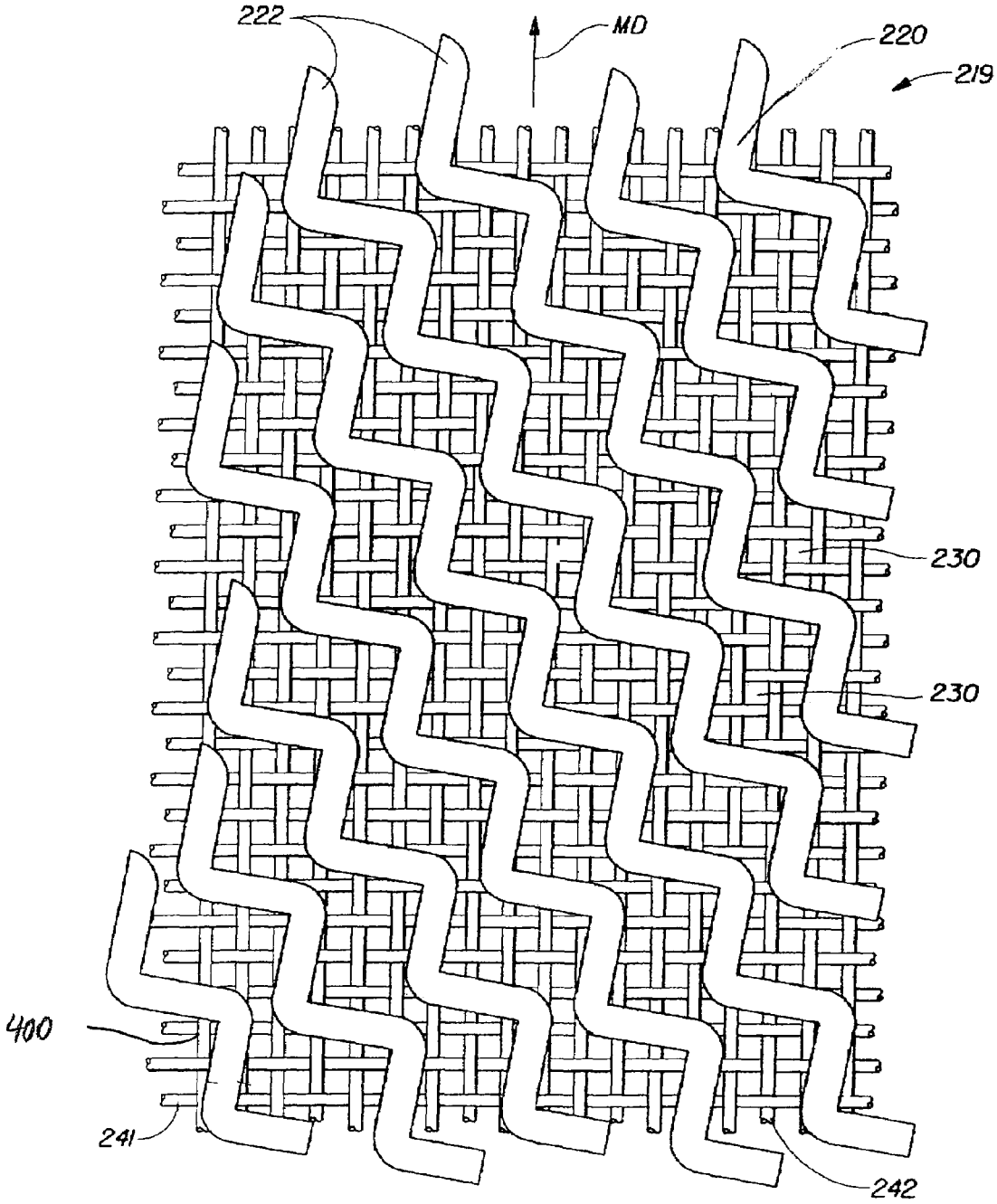
FIG. 4 illustrates a schematic plan view of another embodiment of the invention.

In yet another embodiment shown in FIG. 4, clothing 219 can have a deflection member 220 comprising a plurality of semicontinuous web imprinting surfaces 222. As used herein, a pattern of web imprinting surfaces 222 is considered to be semicontinuous if a plurality of the imprinting surfaces 222 extend substantially unbroken along any one direction on the deflection member 220, and each imprinting surface is spaced apart from adjacent imprinting surfaces 220 by a deflection conduit 230. The deflection member 220 shown in FIG. 4 has adjacent semicontinuous imprinting surfaces 222 spaced apart by semicontinuous deflection conduits 230. The semicontinuous imprinting surfaces 222 can extend generally parallel to the machine or cross-machine directions, or alternatively, extend along a direction forming an angle with respect to the machine and cross-machine directions, as shown in FIG. 4.

Portions of the uppermost macroscopically monoplanar surface may at least partially overlap portions of lower macroscopically monoplanar surfaces forming cantilever portions.

In one embodiment shown in FIG. 2 the deflection member 220 may comprise a continuous network pattern. In another embodiment shown in FIG. 3, the deflection conduit may comprise a continuous network pattern and one or more discrete deflection members 220 each having a web contacting surface 222. In another embodiment shown in FIG. 4, the deflection member 220 may comprise a semi-continuous network pattern. The deflection member 220 may also comprise combinations of continuous, semi-continuous and discrete pattern elements In one embodiment, the deflection member 220 may be formed by applying a layer of a liquid photosensitive polymeric resin to the woven structure. The applied resin may be selected such that the resin cures from a liquid to a solid upon exposure to actinic radiation. The combination of the woven structure and the liquid resin may subsequently be exposed to actinic radiation. The resin may be selectively exposed by disposing a patterned mask adapted to selectively block the actinic radiation between the radiation source and the resin. The pattern of the mask selectively shields portions of the resin such that the shielded portions are not exposed to the activating radiation. The unexposed resin remains substantially unsolidified. The exposed resin portions cure to become substantially solid and at least semi-durable. The combination of the woven structure and the resin may subsequently be showered with a liquid, or subjected to a pressurized gas flow to remove unsolidified resin.

The removal of the unhardened resin may leave a pattern of cured resin mechanically coupled to the woven warp filaments 242 and weft filaments 241. The resin, warp filaments 242 and weft filaments 241 may be selected such that the cured resin adheres at most to one of the warp filaments and weft filaments. In one embodiment the cured resin adheres to either the warp filaments or the weft filaments. In another embodiment the cured resin adheres to neither the warp filaments nor weft filaments. The cured resin defines at least one deflection conduit as described above. The cured resin may comprise the deflection member as set forth above. The pattern of the mask may be selected to provide a pattern of cured resin that is substantially continuous, substantially semi-continuous, discrete or a combination thereof.

The clothing may comprise opaque filaments as described above. The presence of opaque filaments in the woven structure of the clothing 219 may impact the form of the cured resin. The opaque filaments may block the passage of actinic radiation through the woven structure and may shield at least a portion of the resin located beneath the opaque filaments from the actinic radiation. The shielded resin may remain unsolidified and may subsequently be removed from the clothing. As a result of the removal of at least a portion of this resin the second surface 224 of the deflection member may be irregular and may permit lateral fluid flow parallel to the plane of the clothing.

In one embodiment, additional macroscopic monoplanar patterned layers may be added by the repetition of the process described above. A liquid resin may again be applied to the clothing and subjected to actinic radiation through a patterned mask or otherwise subjected to a selective curing means. The successive applications and curing of a resin may yield multiple patterned structures at a single elevation or at multiple elevations.

In another embodiment, a macroscopically monoplanar patterned layer may be formed separately from the combination of the woven structure and any other macroscopically monoplanar layers and subsequently bonded to the combination using means known to those of skill in the art. In one such embodiment, a liquid resin may be applied to a textured forming surface and at least partially cured. This textured layer may subsequently be disposed in a face-to-face relationship with the clothing described above and bonded to the clothing. The bonding of the new layer and the clothing may be achieved via any means known in the art. Exemplary means include, without being limiting, the use of an appropriate adhesive that will bond to each of the clothing and textured layers, partially curing the resin of one or both of the textured layer or clothing and subsequently curing the remaining resin after the disposition of the textured layer in a face-to-face relationship with the clothing. The textured layer may be bonded to the clothing in such a manner as to register the pattern of the textured layer with the pattern of the resinous layer of the clothing. Alternatively, the texture of the new layer may be unregistered with respect to the pattern of the resinous layer of the clothing.

In another such embodiment, a layer of resin may be formed on a smooth surface. The resin may subsequently be exposed to actinic radiation at least partially occluded by a patterned mask as described above. The resin may be at least partially cured by this exposure. The uncured resin may subsequently be removed and the at least partially cured resinous layer may be disposed in a face-to-face relationship with the clothing and subsequently bonded to the clothing.

All documents cited in the Detailed Description of the Invention are, in relevant part, incorporated herein by reference, the citation of any document is not to be considered as an admission that it is prior art with respect to the present invention.

While particular embodiments of the present invention have been illustrated and described, it would have been obvious to those skilled in the art that various other changes and modifications can be made without departing from the spirit and scope of the invention. It is therefore intended to cover in the appended claims all such changes and modifications that are within the scope of the invention.

What is claimed is:

1. A paper-machine clothing comprising a set of first filaments and a set of second filaments, wherein the first filaments are interwoven with the second filaments, at least one first filament contacts at least one second filament at an intersection point defining void spaces between the set of first filaments and the set of second filaments, the clothing further comprising a filling component that substantially fills the void spaces, the filling component adhering to at most one of the set of first filaments and the set of second filaments.

2. The paper-machine clothing of claim 1 further comprising a framework comprising a first macroscopically monoplanar surface defining a plurality of deflection conduits.

3. A paper-machine clothing comprising:

a) a first set comprising first filaments wherein at least one first filament comprises a periphery comprising a first component having a first melting point, b) a second set comprising second filaments having a second melting point greater than the first melting point, the second filaments interwoven with the first filaments, wherein the interwoven first filaments and second filaments are heated to a temperature at least about the first melting point and below the second melting point, and wherein the first filaments do not bond with the second filaments.

4. The paper-machine clothing according to claim 3 wherein the first filaments comprise bicomponent filaments comprising a sheath component and a core component wherein the first component comprises the sheath component and the core component has a melting point greater than the first melting point.

5. The paper-machine clothing according to claim 3 wherein the second set comprises bicomponent filaments.

6. The paper-machine clothing according to claim 3 wherein the second set comprises opaque filaments.

7. The paper-machine clothing according to claim 3 wherein the first set comprises warp filaments.

8. The paper-machine clothing according to claim 3 wherein the first set comprises weft filaments.

9. The paper-machine clothing according to claim 3 wherein at least one first filament comprises a longitudinal cross-section and contacts at least one second filament comprising an axial cross-section at an intersection point, and wherein the longitudinal cross-section of the at least one first filament at the intersection point substantially conforms to the axial cross-section of the second filament at the intersection point.

10. A paper-machine clothing comprising:

a) a framework comprising a first macroscopically monoplanar surface defining a plurality of deflection conduits, and b) a foraminous member comprising:

i) a first set comprising first filaments wherein at least one first filament comprises a periphery comprising a first component having a first melting point, ii) a second set comprising second filaments having a second melting point greater than the first melting point, the second filaments interwoven with the first filaments, wherein the interwoven first filaments and second filaments are heated to a temperature at least about the first melting point and below the second melting point, and wherein the first filaments do not bond with the second filaments.

11. The paper-machine clothing according to claim 10 wherein the first filaments comprise bicomponent filaments comprising a sheath component and a core component wherein the first component comprises the sheath component and has a melting point lower than the core component.

12. The paper-machine clothing according to claim 10 wherein the second set comprises bicomponent filaments.

13. The paper-machine clothing according to claim 10 wherein the second set comprises opaque filaments.

14. The paper-machine clothing according to claim 10 wherein the first set comprises warp filaments.

15. The paper-machine clothing according to claim 10 wherein the first set comprises weft filaments.

16. The paper-machine clothing according to claim 10 wherein the framework comprises a pattern selected from the group consisting of a continuous network pattern, a semi-continuous network pattern, and a pattern of discrete elements.

17. The paper-machine clothing according to claim 10 wherein at least one first filament comprises a longitudinal cross-section and contacts at least one second filament comprising an axial cross-section at an intersection point, and wherein the longitudinal cross-section of the at least one first filament at the intersection point substantially conforms to the axial cross-section of the second filament at the intersection point.

18. The paper-machine clothing according to claim 10 wherein the framework comprises a solid polymeric material which has been rendered solid by exposing a liquid photosensitive resin to radiation of an activating wavelength.

19. The paper-machine clothing according to claim 10 wherein the framework further comprises a second macroscopically monoplanar surface disposed at an elevation different from an elevation of the first macroscopically monoplanar surface.

20. The paper-machine clothing according to claim 19 wherein the second macroscopically monoplanar surface comprises a pattern selected from the group consisting of a continuous network pattern, a semi-continuous network pattern, and a pattern of discrete elements.

* * * * *